US006220173B1

(12) United States Patent
Sauerwein

(10) Patent No.: US 6,220,173 B1
(45) Date of Patent: Apr. 24, 2001

(54) TROLLEY FOR RAIL TRACKS THAT ARE BRANCHED BY MEANS OF SWITCH POINTS

(75) Inventor: Richard Sauerwein, Höhenkirchen (DE)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/097,622

(22) Filed: Jun. 16, 1998

(30) Foreign Application Priority Data

Jun. 18, 1997 (DE) ..... 197 25 644

(51) Int. Cl.[7] ..... E01B 7/00

(52) U.S. Cl. ..... 104/130.1; 104/106; 104/119; 104/130.9; 104/139; 104/288; 104/290; 104/96

(58) Field of Search ..... 104/130, 105, 104/106, 108, 119, 130.9, 130.1, 139, 287, 288, 290, 292, 130.7, 96

(56) References Cited

U.S. PATENT DOCUMENTS

| | | | | |
|---|---|---|---|---|
| 750,162 | * | 1/1904 | Brosnan | 104/12 |
| 3,793,963 | | 2/1974 | Mooney et al. . | |
| 3,830,162 | * | 8/1974 | Marten | 104/105 |
| 3,874,299 | * | 4/1975 | Silva et al. | 104/130 |
| 4,214,535 | * | 7/1980 | Gerhard | 104/91 |
| 4,671,185 | * | 6/1987 | Anderson et al. | 104/130 |
| 4,845,806 | * | 7/1989 | Hamacher | 16/88 |
| 4,919,056 | | 4/1990 | Gronau . | |
| 4,934,279 | * | 6/1990 | Azukizawa et al. | 104/130.1 |
| 4,991,257 | * | 2/1991 | Eutebach | 16/87 |
| 5,134,324 | * | 7/1992 | Sakagami et al. | 310/12 |
| 6,058,849 | * | 5/2000 | Ostholt et al. | 104/93 |

FOREIGN PATENT DOCUMENTS

| | | |
|---|---|---|
| 6945125 | 7/1969 | (DE) . |
| 2150408 | 10/1971 | (DE) . |
| 2743316 | 3/1979 | (DE) . |
| 2144090 | 2/1973 | (FR) . |

* cited by examiner

*Primary Examiner*—S. Joseph Morano
*Assistant Examiner*—Frantz F. Jules
(74) *Attorney, Agent, or Firm*—Ware, Fressola, Van Der Sluys & Adolphson LLP

(57) ABSTRACT

The invention concerns a trolley for rail tracks (3) that are branched by means of switch points. To avoid a switch point jam, while simultaneously saving power and maintenance effort, the trolley is equipped with moveable hooks and the switch points are designed as passive switches without any moveable parts, where the hooks can engage the guide rails (12) of the passive switch points in accordance with the desired travel direction.

6 Claims, 2 Drawing Sheets

TROLLEY FOR RAIL TRACKS THAT ARE BRANCHED BY MEANS OF SWITCH POINTS

TECHNICAL FIELD

The invention concerns a trolley—switch point configuration.

BACKGROUND OF THE INVENTION

Railway vehicles of any kind, particularly passenger trains, freight trains, electric trolleys for transportation inside of closed spaces such as production halls, sorting stations or high shelf storage, whether suspended or on the ground, must be routed in the desired travel direction via rail tracks that are branched by means of switch points.

Switch points that are equipped with moveable rail parts are known; they can be inserted into a gap in one or the other railway direction for deflecting or shifting. The power required to move the rail parts is considerable. Beyond that, wear in conjunction with the effect of weather and contamination are a disadvantage. Such mechanical, i.e. active switch points require intensive maintenance. Their use in explosion-proof and wet spaces is almost impossible and is not permitted in most areas.

So-called turntables are also known, in which the railway vehicles or individual railway cars are turned around with the turntable until a seamless transfer is established to the desired connecting track direction. In this case the fairly considerable power requirement is also a disadvantage. The danger of a switch point jam must also be considered. Railway vehicles or trolleys which closely follow each other can jam at the branch sections, since the operation of the turntables, as well as the above-cited deflecting switch points, require a long time for each vehicle. The trolleys must stop or at least slow down in any event. This very much restricts the passage of trolleys, i.e. the traffic density.

SUMMARY OF THE INVENTION

The object of the invention is to improve a trolley-switch point configuration in regard to power consumption, maintenance requirement, trolley passage and wear as well as contamination. It must further be endeavored to provide unrestricted access to explosion-proof and wet spaces.

The invention achieves this object by a trolley for rail tracks that are branched by means of switch points, wherein the trolley has moveable hooks, and the switch points are designed as passive switches without any moveable parts, where the hooks can engage the guide rails of the passive switches in accordance with the desired travel direction. The basic idea of the invention is to interchange the fixed and moveable components of the trolley and the switch points needed to pass through the branches. This provides the possibility of creating constructions which are characterized by very little power consumption, smooth passage through the branches without any stopping or braking phase, and low wear as well as a significant decrease in the required maintenance.

The invention also illustrates constructions that have advantageous further developments of the basic idea for an electric ground trolley (EBB) and an electric suspended trolley (EHB). In that case the passive switches are designed as a slotted hollow profile and provided with the guide rails, while the hook discussed above is designed as a rocker both ends of which are able to alternatively engage one of the two guide rails. The guide rail and the rocker may be located inside the hollow profile. This produces an effective protection against mechanical damage and contaminative as well as environmental influences. Such electric trolleys (EBB and EHB) are especially designed for use in workshops. However, their use for passenger and freight traffic is also conceivable. This allows the omission of heated active switches and their expensive control devices, which must comply with high safety standards. It is only necessary for the electric or diesel locomotive to have a device that engages a passive switch guide rail in a way so that the locomotive and all of its coupled cars are forced into the desired direction. However the following configurations refer only to the electric ground trolley and the electric suspended trolley for industrial applications, while their exemplary nature is emphasized.

Configurations are also illustrated for electric suspended trolleys that have advantageous designs which are characterized by good stability and friction properties. The guide rod or the holding device can pass through the longitudinal slot in an almost contactless manner.

It is preferred to control the position of the rocker by means of contactless inductive power transfer heads. This gives an advantageous smoothness to the rocker movements. The power demand of the electric ground trolley or the electric suspended trolley is also covered in a contactless manner by the inductive power transmission.

The travel direction can be established by controlling the switch points, as is the case with conventional switches. However no moving parts are required within the switch point. The moving part is the rocker, which is a component of the electric ground trolley or the electric suspended trolley.

Trolleys with a preprogrammed travel destination can establish the travel direction immediately before a branch. This variation is especially advantageous with trolleys following closely behind each other, which do not travel in accordance with a time schedule, but detect advancing trolleys by means of distance sensors for example, and autonomously compute the optimum routes for reaching a predetermined target point by means of an intelligent logic. Such systems are very flexible and can be used to advantage for example in assembly lines which process large lot sizes.

The free ends of the rocker can be provided with guide wheels to enable quiet and low friction shunting at branch points. In that case the guide wheels are used as quasi-hooks.

BRIEF DESCRIPTION OF THE DRAWINGS

The invention is explained in greater detail in the following by means of two figuratively illustrated embodiments, where.

BEST MODE FOR CARRYING OUT THE INVENTION

Figure 1A:
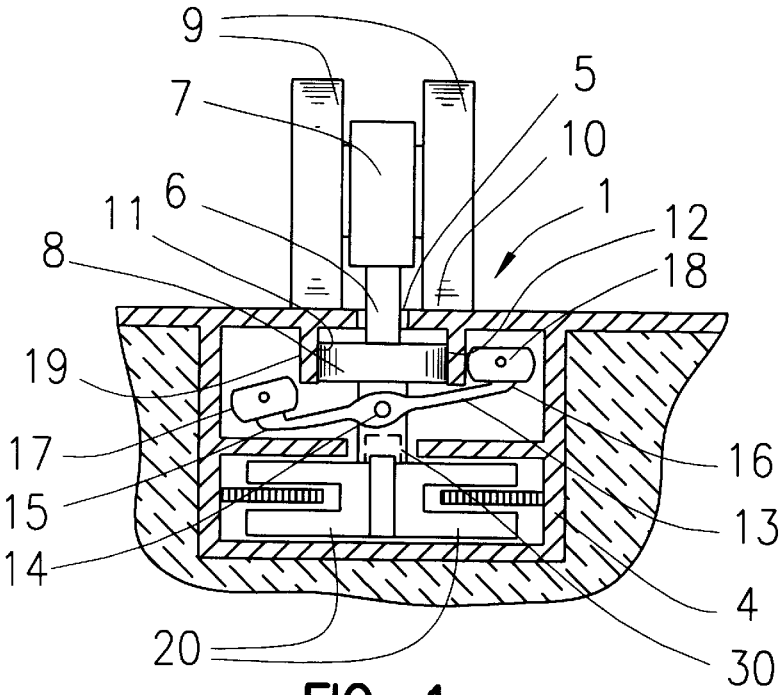
FIG. 1*a* is a cross section of the essential components of an electric ground trolley (EBB) in conjunction with a branch point.
Figure 1B:
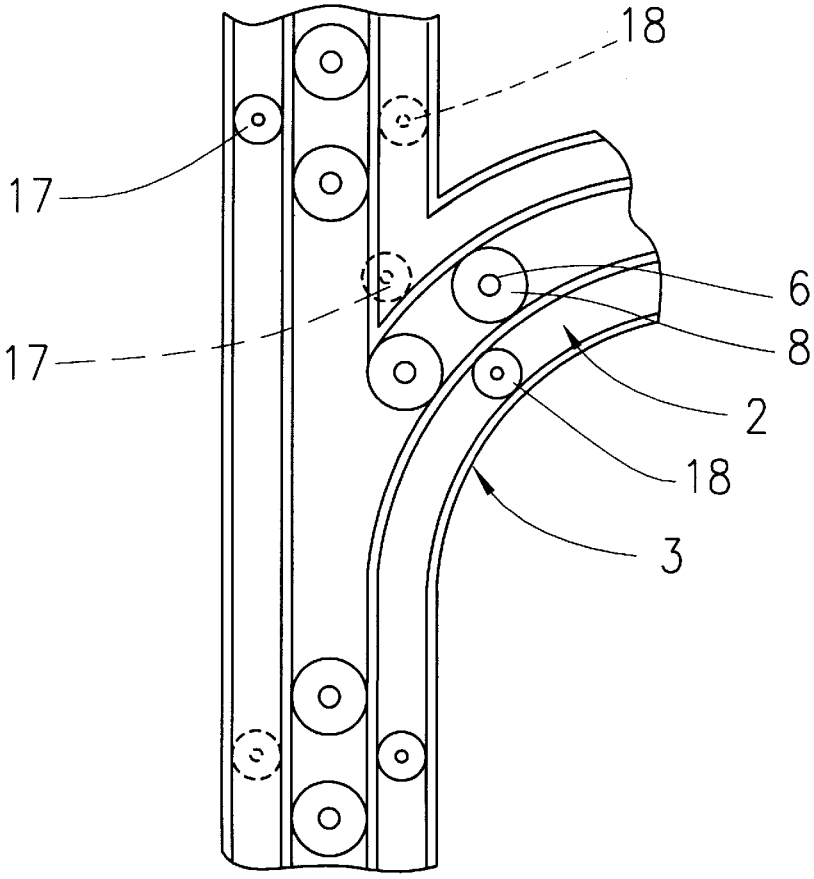
FIG. 1*b* is a schematic top view of a branch point.

FIG. 1*a* illustrates the lower part of an electric ground trolley EBB 1 interacting with a branch area 2 of a rail track arrangement 3 (See FIG. 1*b*). The rail track arrangement 3 is essentially designed as a hollow profile 4 with a longitudinal slot 5 on top. A guide rod 6 of the EBB 1 penetrates into the longitudinal slot 5, and is connected on the top to an undercarriage axle 7, and on the bottom to a support bearing 8 and a rocker 13. The undercarriage axle 7 connects two drive wheels 9 to each other, which are able to move on both sides of the longitudinal slot 5 on the top 10 of the hollow profile 4, and cause the EBB 1 to move forward. The support bearing 8, for example a ball bearing, interacts with the inside 11 of two guide rails 12 of the hollow profile 4. The guide rails 12 penetrate into the hollow profile 4 on both sides of the longitudinal slot 5. Under the guide rails and the support bearing unit 12/8, the rocker 13 is located above an axis of rotation 14 which is connected to the guide rod 6. The free ends 15 and 16 of the rocker 13 have upwards facing guide wheels 17 and 18 installed on them. They are able to engage the guide rails 12, depending on the position of the rocker 13. In the position illustrated in FIG. 1 the right guide wheel 18 is engaged, which causes the EBB 1 to veer to the right. In the other rocker position, where the left guide wheel 17 on the free left end 15 is engaged, the EBB 1 in FIG. 1*b* would continue to travel straight on the rail track arrangement 3. The rocker 13 is controlled by two mirror-symmetrical inductive power transfer heads 20, which are located in the lower part of the hollow profile 4 opposite the free ends 15 and 16 of the rocker 13. Depending on the electrification of the two power transfer heads 20, either the left free end 15 or the right free end 16 of the rocker 13 is attracted, so that the respective other free end with the corresponding guide wheel 17 or 18 engages one of the guide rails 12. on the outside 19 of the two guide rails 12. Additionally, the inductive power transfer heads (20) can be controlled by an intelligent logic 30 which is integrated in the trolley and which is able to compute an optimum trajectory.

Figure 2A:
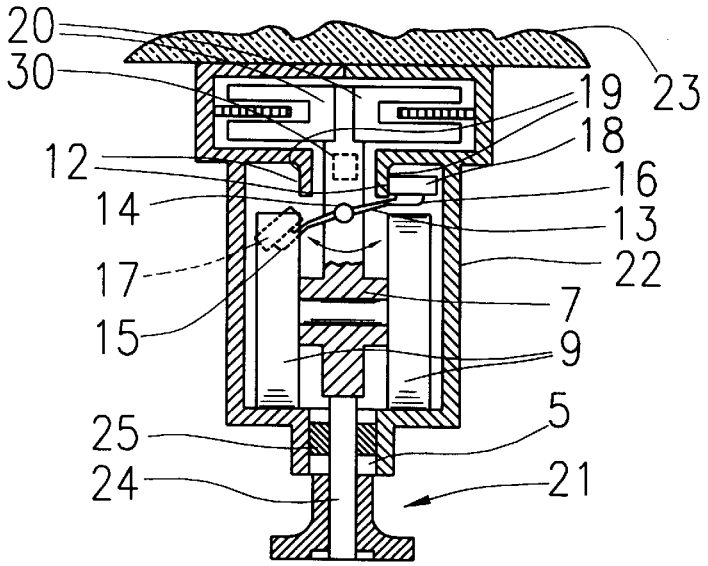
FIG. 2*a* is the same as 1*a* but for an electric suspended trolley (EHB)
Figure 2B:
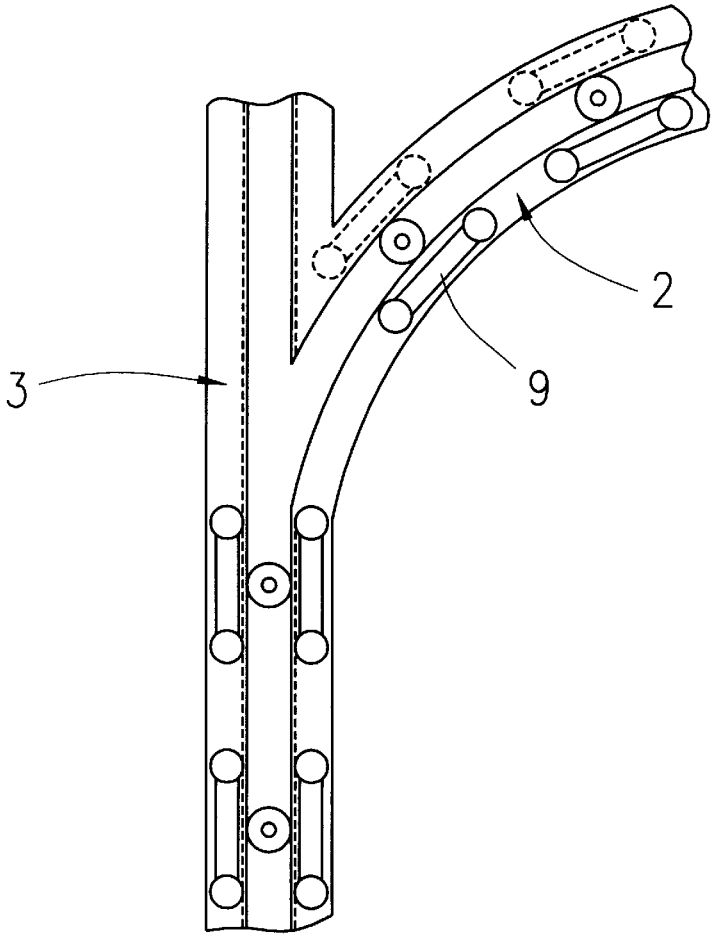
FIG. 2*b* is the same as 1*b* but for an electric suspended trolley (EHB).

The same rocker principle is provided for the electric suspended trolley EHB 21 illustrated in FIGS. 2*a* and 2*b*. It can be seen that in the illustrated position of the rocker 13, the EHB 21 is driven to the right and thus into a right turn. A modified hollow profile 22 is attached to a ceiling structure 23. In addition to the rocker 13 and the inductive power transfer heads 20, the hollow profile 22 also contains the drive wheels 9 of the EHB 21. The top of the undercarriage axle 7 is connected to the axis of rotation 14 of the rocker 13, and the bottom to a holding device 24 which penetrates into the longitudinal slot 5, for a not illustrated cargo to be transported. In the same manner as the guide rod 6 of EBB 1, the holding device 24 of EHB 22 is equipped with a support bearing 25, which contacts a neck-shaped extension of the longitudinal slot 5.

The invention is not limited to the embodiments indicated above. Rather a member of variations can be envisioned in which other basically different configurations utilize the features of the invention.

What is claimed is:

1. A trolley for rail tracks (3) that are branched by means of switch points, characterized in that the trolley has moveable hooks, and the switch points are designed as passive switches without any moveable parts, where the hooks can engage a guide rail (12) of a passive switch in accordance with the desired travel direction, wherein the rail tracks (3) are suspended from a ceiling structure (23) and have an essentially closed hollow profile with a longitudinal slot (5) on its underside in order to protect against mechanical damage and contamination as well as environmental influences, and the inside of the hollow profile (22) has at least one drive wheel (9) for the electric suspended trolley EHB (21), which is connected to at least one holding device (24) for cargo to be transported which penetrates into the longitudinal slot (5), characterized in that, at least in the area of a branched section (2) on both sides of the longitudinal slot (5), the hollow profile (22) has a corresponding guide rail (12) parallel to the longitudinal slot, which can be engaged by ends (15, 16) of a single rocker (13) on the electric suspended trolley (EHB), wherein the holding device (24) has a support bearing (25), which fits a channel formed in the hollow profile (22), wherein at least in the area of the branched sections (2), the hollow profile (22) has inductive power transfer heads (20) which are assigned to the ends (15, 16) of the rocker (13), wherein free ends (15, 16) of the rocker (13) are equipped with guide wheels, and wherein the inductive power transfer heads (20) can be controlled by an intelligent logic which is integrated in the trolley and is able to compute an optimum trajectory.

2. The trolley of claim 1, wherein the at least one drive wheel (9) is located between the electric suspended trolley (21) and the guide rail (12).

3. A trolley for rail tracks (3) that are branched by means of switch points, characterized in that the trolley has moveable hooks, and the switch points are designed as passive switches without any moveable parts, where the hooks can engage the guide rail (12) of the passive switches in accordance with the desired travel direction, wherein the rail tracks (3) have an essentially closed hollow profile (4) with a longitudinal slot (5) on a top of the rail tracks in order to protect against mechanical damage and contamination as well as environmental influences, and at least one drive wheel (9) for the electric ground trolley (EBB) (1) on top of the hollow profile (4), which is connected to at least one holding device for cargo to be transported, and is steered by a guide rod (6) which penetrates into the longitudinal slot (5), characterized in that, at least in the area of a branched section (2) on both sides of the longitudinal slot (5), the hollow profile (4) has a corresponding guide rail (12) parallel to the longitudinal slot, which can be engaged by an end (15, 16) of a single rocker (13) on the electric ground trolley (EHB) (21), wherein the guide rod (6) has a support bearing (8), which fits a channel formed in the hollow profile (4), wherein at least in the area of the branched sections (2), the hollow profile (4) has inductive power transfer heads (20) which are assigned to the ends (15, 16) of the rocker (13), and wherein the inductive power transfer heads (20) can be controlled by an intelligent logic which is integrated in the trolley and is able to compute an optimum trajectory.

4. The trolley of claim 3, wherein the at least one drive wheel (9) is located between the trolley (21) and the guide rail (12).

5. A trolley for rail tracks (3) that are branched by means of switch points, characterized in that the trolley has moveable hooks, and the switch points are designed as passive switches without any moveable parts, where the hooks can engage the guide rail (12) of the passive switches in accordance with the desired travel direction, and wherein the rail tracks (3) have an essentially closed hollow profile (4) with a longitudinal slot (5) in the rail tracks in order to protect against mechanical damage and contamination as well as environmental influences, and at least one drive wheel (9) for the trolley, which is connected to at least one holding device for cargo to be transported, and is steered by a guide rod (6) which penetrates into the longitudinal slot (5), characterized in that, at least in the area of a branched section (2) on both sides of the longitudinal slot (5), the hollow profile (4) has a corresponding guide rail (12) parallel to the longitudinal slot, which can be engaged by an end (15, 16) of a single rocker (13) on the trolley.

6. The trolley of claim 5, wherein the at least one drive wheel (9) is located between the trolley (21) and the guide rail (12).

* * * * *